US007410172B1

(12) United States Patent
Muskin

(10) Patent No.: US 7,410,172 B1
(45) Date of Patent: Aug. 12, 2008

(54) CASINO POKER GAMES

(75) Inventor: Jon H. Muskin, Philadelphia, PA (US)

(73) Assignee: Olympian Gaming LLC, Beaverton, OR (US)

( * ) Notice: Subject to any disclaimer, the term of this patent is extended or adjusted under 35 U.S.C. 154(b) by 130 days.

(21) Appl. No.: 11/242,636

(22) Filed: Oct. 3, 2005

Related U.S. Application Data

(60) Provisional application No. 60/615,225, filed on Oct. 1, 2004.

(51) Int. Cl.
*A63F 1/00* (2006.01)

(52) U.S. Cl. ..... 273/292

(58) Field of Classification Search ..... 273/292
See application file for complete search history.

(56) References Cited

U.S. PATENT DOCUMENTS 4,364,567 A * 12/1982 Goott ..... 273/237
4,836,553 A 6/1989 Suttle
4,948,134 A * 8/1990 Suttle et al. ..... 463/13
5,022,653 A * 6/1991 Suttle et al. ..... 463/13
5,100,137 A * 3/1992 Fulton ..... 463/13
5,732,950 A * 3/1998 Moody ..... 273/292
5,823,873 A * 10/1998 Moody ..... 463/13
6,027,119 A * 2/2000 De Lisle ..... 273/292
6,332,614 B1 * 12/2001 Hesse ..... 273/292
6,379,245 B2 * 4/2002 De Keller ..... 463/13
6,698,759 B2 3/2004 Webb
7,222,858 B2 * 5/2007 Moody ..... 273/292
2002/0008356 A1 * 1/2002 De Keller ..... 273/292
2006/0049581 A1 3/2006 Buford
2006/0071427 A1 * 4/2006 Van Dyke ..... 273/292

* cited by examiner

*Primary Examiner*—Gene Kim
*Assistant Examiner*—Dolores R. Collins
(74) *Attorney, Agent, or Firm*—Muskin & Cusick LLC

(57) ABSTRACT

A method of implementing a casino table poker game, the method including (a) receiving an ante wager from a player, (b) dealing a player's hand and a dealer's hand, (c) determining by the player whether to raise or fold, (d) if the player raises in the determining, then the player places a raise wager and then both the player's hand and the dealer's hand are revealed, (e) evaluating who has the higher hand, the dealer or the player, (f) if the dealer has the higher hand in the evaluating, then the player loses the ante wager and the raise wager, and (g) if the player has the higher hand in the evaluating, then the player pushes on the ante wager and wins a paytable payout on the raise wager.

3 Claims, 1 Drawing Sheet

CASINO POKER GAMES

CROSS REFERENCE TO RELATED APPLICATIONS

This application claims benefit of provisional application No. 60/615,225, filed on Oct. 1, 2004 which is incorporated by reference herein in its entirety.

BACKGROUND OF THE INVENTION

1. Field of the Invention

The present invention is directed to a method, apparatus, and computer readable storage medium directed to casino poker games.

2. Description of the Related Art

Casino games are a billion dollar industry, both in the U.S. and around the world.

What is needed is a new poker game which can increase player enjoyment as well as casino revenue.

SUMMARY OF THE INVENTION

It is an aspect of the present invention to provide enjoyable casino poker games.

The above aspects can be obtained by a method that includes (a) receiving an ante wager from a player, (b) dealing a player's hand and a dealer's hand, (c) determining by the player whether to raise or fold, (d) if the player raises in the determining, then the player places a raise wager and then both the player's hand and the dealer's hand are revealed, (e) evaluating who has the higher hand, the dealer or the player, (f) if the dealer has the higher hand in the evaluating, then the player loses the ante wager and the raise wager, and (g) if the player has the higher hand in the evaluating, then the player pushes on the ante wager and wins a paytable payout on the raise wager.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
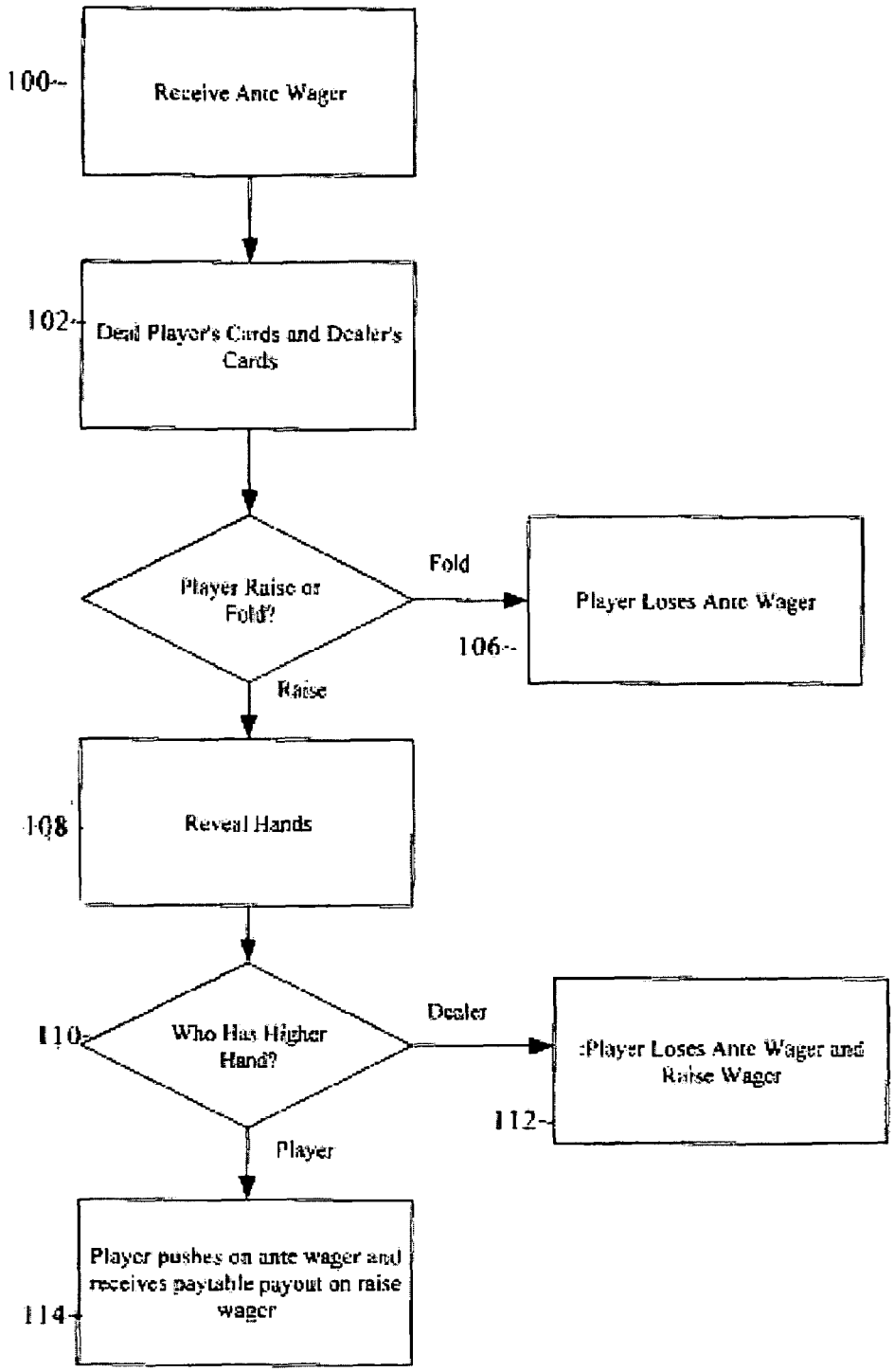
FIG. 1 is illustrates an exemplary method of implementing a poker game, according to an embodiment.

Reference will now be made in detail to the presently preferred embodiments of the invention, examples of which are illustrated in the accompanying drawings, wherein like reference numerals refer to like elements throughout.

The present inventive concept relates to a poker game.

FIG. 1 is illustrates an exemplary method of implementing a poker game, according to an embodiment.

The method can start with operation 100, which receives an ante wager (typically from a player).

From operation 100, the method can proceed to operation 102, which deals players cards and dealers cards. Any number of cards can be used (e.g. 2, 3, or more).

From operation 102, the method can proceed to operation 104, wherein the player decides whether to raise or fold. If the player folds, then the method can proceed to operation 106, wherein the player loses his or her ante wager.

If the player raises, then the method can proceed to operation 108, which reveals hands (both the player's and the dealer's).

The raise wager can be equal to the ante wager, or the player can raise only one of 2X, 3X (where X is the ante). Or, the player can choose to raise 1X to 2X, or 1X to 3X, or aX to bX, wherein a is the minimum raise and b is the max raise.

From operation 108, the method can proceed to operation 110, which determines who has the higher hand. If the player has the higher hand, then the method can proceed to operation 114 wherein the player pushes on the ante wager and receives a paytable payout on the raise wager.

The paytable payout is based on the raise wager. For example, if the player's hand a high hand, the player can win 0.5 times the raise wager. If the player's hand is a pair of 10 or less, the player can win the raise wager. If the player's hand is a high pair (jack or better) the player can win two times the raise wager. If the player's hand is three of a kind, the player can win 5 times the raise wager. If the player's hand is a straight flush, the player can win 10 times the raise wager. These are just one example.

If the dealer has the higher hand, then the method can instead proceed to operation 112, wherein the player loses both the ante wager and the raise wager.

It is also noted that any and/or all of the above embodiments, configurations, variations of the present invention described above can be mixed and matched and used in any combination with one another. This also includes any prior document incorporated by reference, and any feature described herein can also be applied to any such documents. Any feature(s) in any claim(s) herein can be combined with any feature(s) in any other claim(s).

Moreover, any description of a component or embodiment herein also includes hardware, software, and configurations which already exist in the prior art and may be necessary to the operation of such component(s) or embodiment(s).

Further, the operations described herein can be performed in any sensible order. Any operations not required for proper operation can be optional. Further, all methods described herein can also be stored on a computer readable storage to control a computer.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A method of playing a poker game, the method comprising:

receiving an ante wager from a player;

dealing a player's hand and a dealer's hand;

determining by the player whether to raise or fold;

if the player raises in the determining, then performing the following:

receiving, from the player, a raise wager and then both the player's hand and the dealer's hand are revealed;

evaluating who has the higher hand, the dealer or the player;

if the dealer has the higher hand in the evaluating, then the player loses the ante wager and the raise wager; and if the player has the higher hand in the evaluating, then the player pushes on the ante wager and wins a paytable payout on the raise wager.

2. The method as recited in claim 1, wherein the paytable payout is based on the player's hand.

3. The method as recited in claim 1, wherein the player can choose as the raise wager from A times the ante wager to B times the ante wager, wherein A is the minimum raise and B is the maximum raise.

* * * * *